United States Patent [19]

Yee

[11] 4,011,826

[45] Mar. 15, 1977

[54] MARINE VESSEL WITH VERTICAL ANNULAR WALLS

[76] Inventor: Alfred A. Yee, 1441 Kapiolani Blvd. Suite 810, Honolulu, Hawaii 96814

[22] Filed: Nov. 14, 1975

[21] Appl. No.: 632,076

[52] U.S. Cl. ..... 114/65 A; 114/26; 114/56

[51] Int. Cl.[2] ..... B63B 5/14

[58] Field of Search ..... 114/65 A, 56, 72, 73, 114/74 R, 74 A, 74 T, .5 T, 26, 5 F

[56] References Cited

UNITED STATES PATENTS 3,833,035 9/1974 Yee ..... 114/.5 T

FOREIGN PATENTS OR APPLICATIONS 132,243 3/1920 United Kingdom ..... 114/65 A

*Primary Examiner*—Trygve M. Blix
*Assistant Examiner*—Sherman D. Basinger
*Attorney, Agent, or Firm*—Clarence A. O'Brien; Harvey B. Jacobson

[57] ABSTRACT

A marine vessel for storage or transport of cargo employing a honeycomb sandwich panel system of concrete construction applied to open or closed deck vessels comprising a plurality of vertically extending annular walls formed monolithically with the hull of the vessel in which the vertical annular walls may extend from the bottom deck or slab to the top deck or slab or between either the top or bottom and an intermediate deck or slab with the annular walls defining a plurality of compartments and serving as vertical shear walls which strengthen the structure to withstand stresses caused by wave action and the like in both longitudinal and transverse directions.

11 Claims, 11 Drawing Figures

MARINE VESSEL WITH VERTICAL ANNULAR WALLS

BACKGROUND OF THE INVENTION

1. Field of the Invention

The present invention generally relates to concrete marine vessels such as transport barges, storage barges and the like constructed from concrete or similar cementitious material in which vertical annular walls are provided between certain horizontal decks or slabs to strengthen the marine vessel whether the vessel is of the closed top deck or open top deck construction.

2. Description of the Prior Art

Various types of concrete marine vessels have been proposed with my U.S. Pat. No. 3,833,035, issued Sept. 3, 1974 illustrating one type of vessel with the structure of that patent and the references cited therein being incorporated herein by reference thereto. The vessel structures illustrated in that patent include vertical cylindrical walls being continuous between a bottom deck or slab and a top deck or slab in which both decks or slabs are of continuous construction.

SUMMARY OF THE INVENTION

An object of the present invention is to provide a marine vessel of concrete construction which constitutes an improvement on the invention disclosed in my U.S. Pat. No. 3,833,035, issued Sept. 3, 1974. In this improvement, the hull may be of the open deck or closed deck type and a plurality of vertical annular walls extend between the decks but are not necessarily continuous between the top and bottom decks but rather, the vertical walls may extend between the bottom deck and an intermediate deck or between the top deck and an intermediate deck or between intermediate decks with the entire structure being of one piece concrete construction thus enabling the vessel to be constructed with cargo receiving holds, tanks and the like.

Another object of the invention is to provide a marine vessel in accordance with the preceding object in the form of a transporting or storage barge in which the annular walls may be associated with partition walls defining holds, tanks, storage areas or the like with the annular walls being either in direct contact tangentially or provided with rigid radial walls extending between adjacent, spaced vertical annular walls.

Still another object of the invention is to provide a marine vessel with vertical annular walls incorporated therein and constructed of concrete in which the annular walls are cylindrical and produce vertical shear support walls associated with horizontal decks and inclined or vertical partitions to strengthen the hull structure of the marine vessel with the structure of the vessel being relatively simple and easy to form but yet quite rigid in construction with the strength of the hull structure being increased by the specific orientation and construction of the annular walls and the related decks and partitions.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
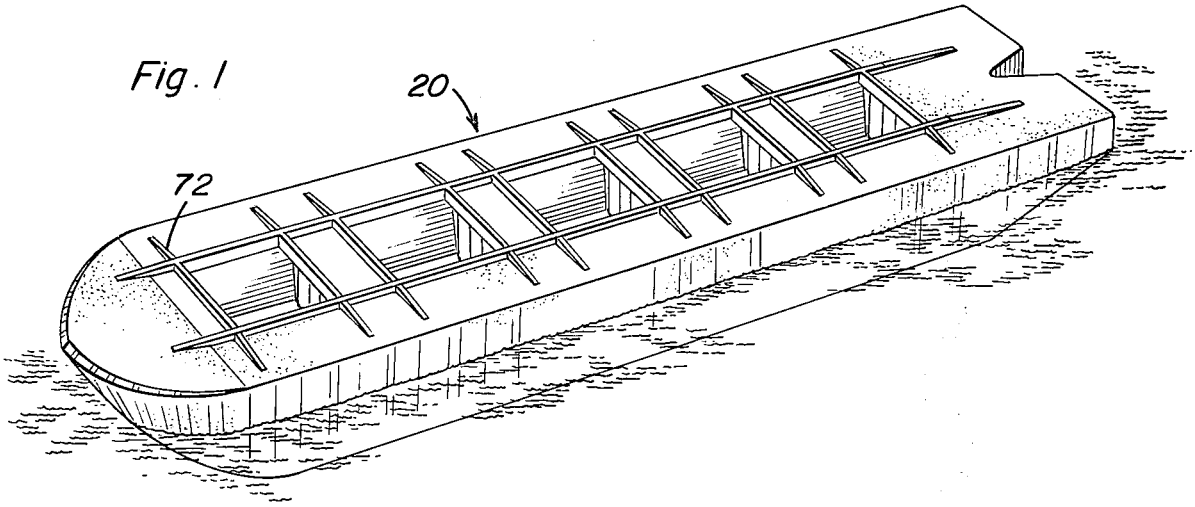
FIG. 1 is a perspective view of a marine vessel in the form of a light barge having a plurality of longitudinally spaced holds therein.
Figure 2:
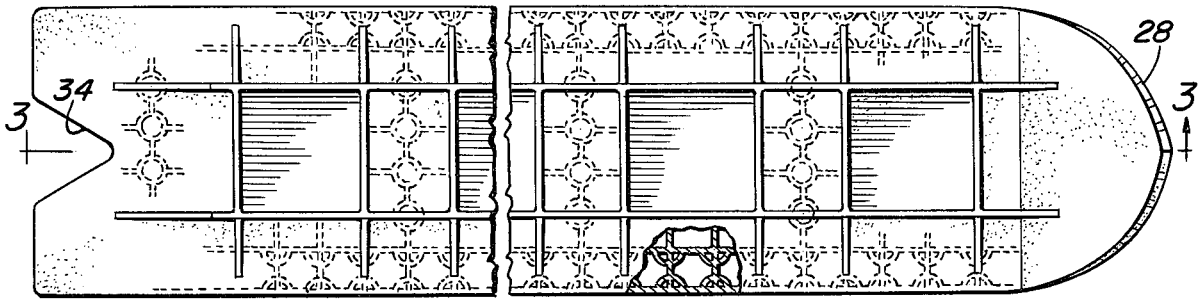
FIG. 2 is a top plan view of the construction of FIG. 1 illustrating further structural details of the marine vessel illustrated in FIG. 1 with portions of the top deck broken away.
Figure 3:
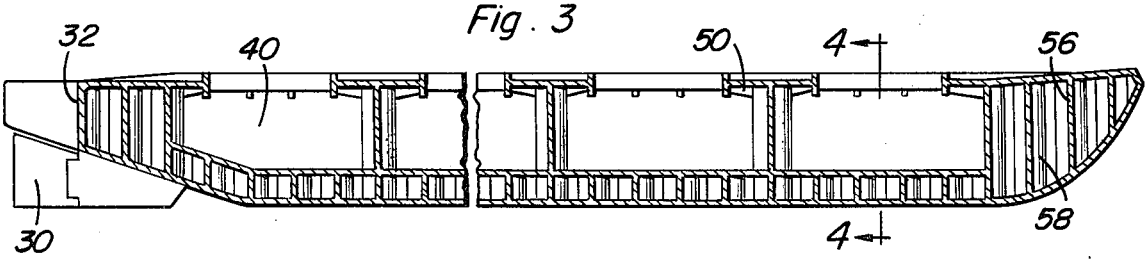
FIG. 3 is a longitudinal, vertical sectional view taken substantially upon a plane passing along section line 3—3 of FIG. 2 illustrating further structural details of this embodiment of the invention.

Referring now specifically to FIGS. 1–4 of the drawings, a marine vessel in the form of a barge is generally designated by reference numeral 20 and includes a bottom deck or slab 22, a top deck or slab 24 and a substantially vertical peripheral side wall 26 in which the bow section of the barge 28 tapers inwardly and curves upwardly as illustrated in FIGS. 1–3 and the stern end of the barge is provided with a rudder 30 depending below the upwardly slanted bottom deck 24 with the stern end of the barge also having a notch 32 therein.

Figure 4:
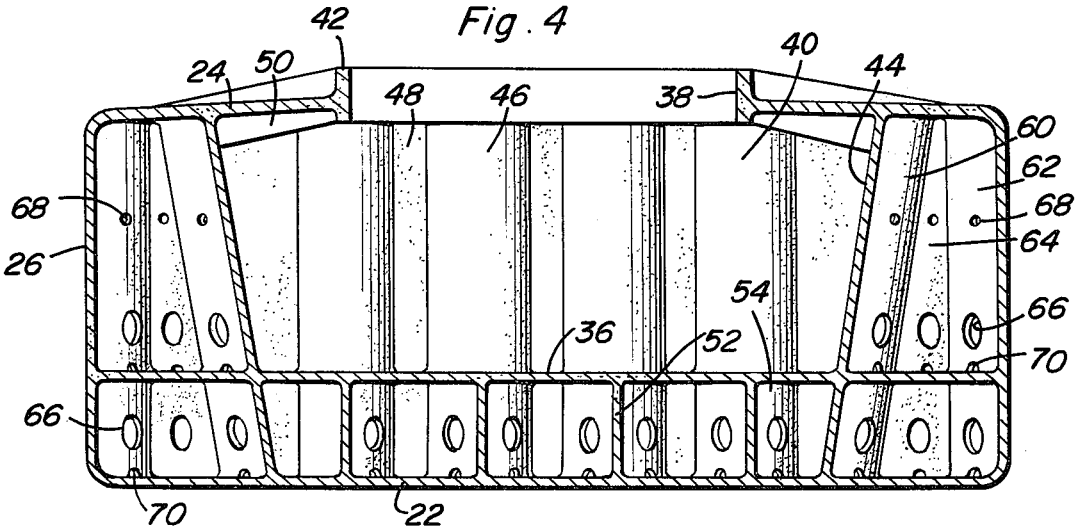
FIG. 4 is a transverse, sectional view, on an enlarged scale, taken substantially upon a plane passing along section line 4—4 of FIG. 3 illustrating further structural details of the decks, partition walls and vertical annular walls.

Spaced above the bottom deck 24 is an intermediate deck or cargo deck 36 which generally parallels the bottom deck and terminates at the bow section and slightly beyond the upwardly slanted rear portion of the bottom deck 24 as illustrated in FIG. 3. The top deck 24 is provided with a plurality of openings 38 therein which define a plurality of longitudinally spaced cargo receiving holds 40 in which the opening 38 has a smaller dimension than the interior dimensions of the cargo space or hold 40 and is defined by a vertical wall 42 which extends both above and below the top deck 24 for a short distance as illustrated in FIG. 4. The side walls of each of the holds 40 or cargo receiving areas is defined by a partition wall 44 that extends from the top deck 24 to the bottom deck 22 in intersecting relation to the cargo deck 36 and slightly inclined from top to bottom with the lower end being inwardly of the upper end as illustrated in FIG. 4. The partition wall 44 may also be oriented in a vertical position when desired. The two end walls of the holds 40 are defined by a plurality of vertical annular walls 46 of cylindrical configuration which are interconnected by a web or flange 48 centrally located and radially extending therefrom as illustrated in FIG. 2. The portion of the top deck 24, between the partition walls 44 and the opening 38 and the partition wall 48 and the opening 38, is provided with reinforcing gussets 50 which have a depth so that the inner edges thereof are flush with the bottom edge of the flange 42 defining the opening 38 with the depth of the reinforcing gussets increasing toward the outer ends thereof.

Disposed between the bottom slab or shell 22 and the intermediate deck 36 is a plurality of vertical partition walls 52 which have a centrally disposed vertical annular wall of cylindrical configuration designated by numeral 54 integral therewith as illustrated in FIGS. 2 and 4. The bow section and stern section of the barge is provided with partition walls or reinforcement walls 56 associated with vertical annular cylindrical walls 58 as illustrated in FIGS. 2 and 3. As illustrated in FIG. 4, the inclined partition walls 44 have semi-cylindrical walls 60 extending along the outer surface thereof and the outer shell or side wall 26 is also provided with semi-cylindrical walls 62 integral therewith. The semi-cylindrical walls are interconnected by radial partition walls 64 with all of the walls outside of the cargo hold 40 including access openings 66, ventilation openings 68 and limber notches or holes 70 at the bottom edges where they join with the deck.

The top deck 24 is also provided with reinforcing gussets 72 for the flange 42 for the cargo hold openings 38 with the flanges 42 serving as a hatch opening which may be provided with any suitable type of closure if desired or necessary. The entire structure of the vessel as described is constructed of concrete or other hardenable material with the vertical cylindrical or semi-walls defining a plurality of compartments which strengthen the vessel and enable it to withstand wave action and the like. In actual practice, the vessel may have an over-all length of 523 feet, a beam of 105 feet, a total height of 56 feet, 6 inches and provided with five holds for receiving any type of cargo with the vertical dimension between the bottom shell 22 and the intermediate deck or cargo deck 36 being 13 feet.

Figure 5:
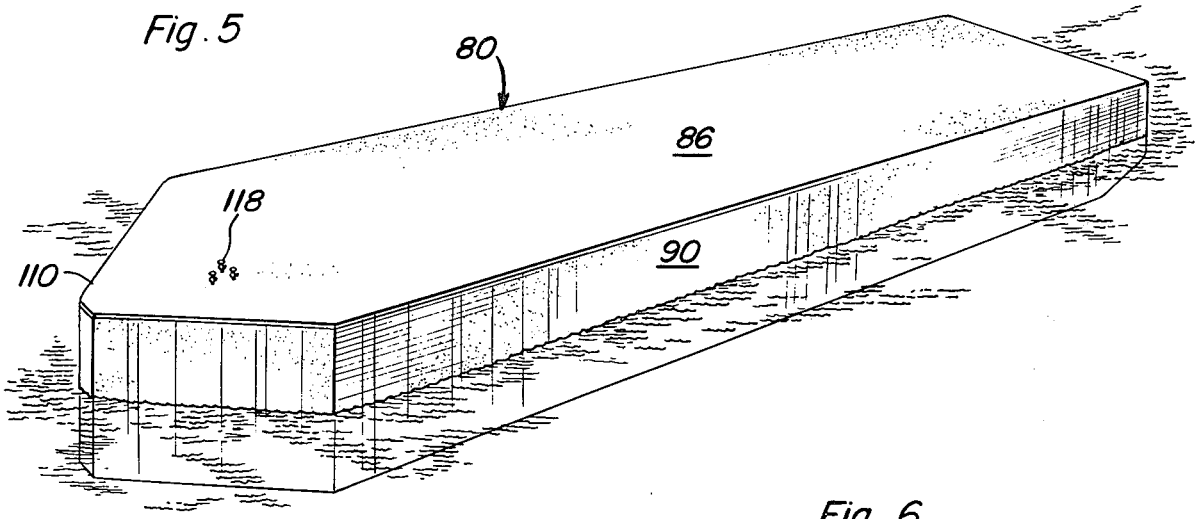
FIG. 5 is a perspective view of a storage barge illustrating continuous top and bottom decks but compartments therein.
Figure 6:
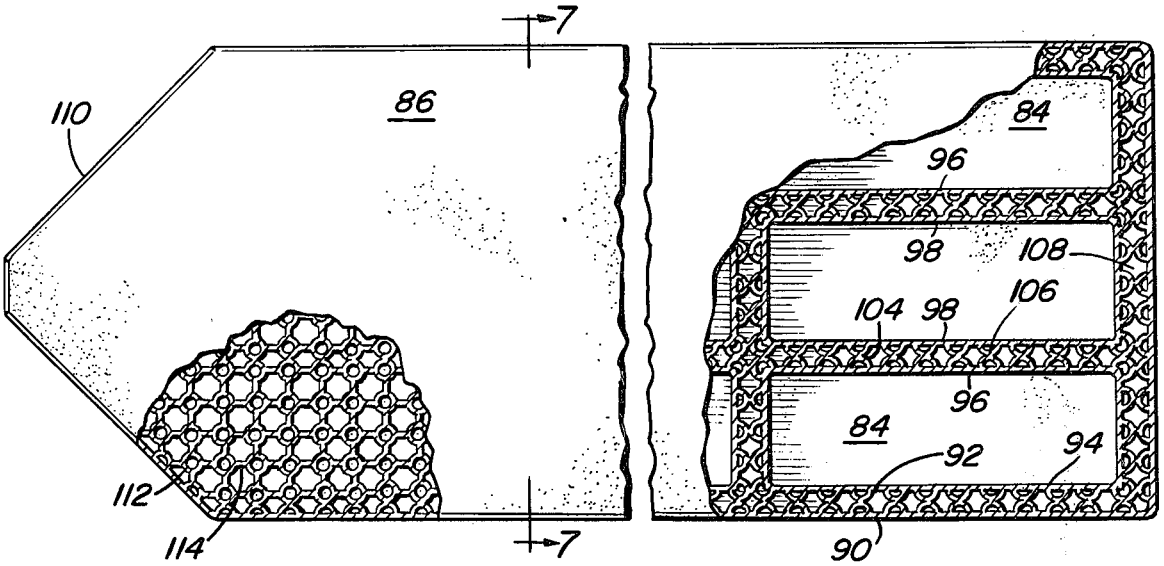
FIG. 6 is a top plan view of the construction of FIG. 5 illustrating the internal structural details of the barge with portions of the top deck being broken away for that purpose.
Figure 7:
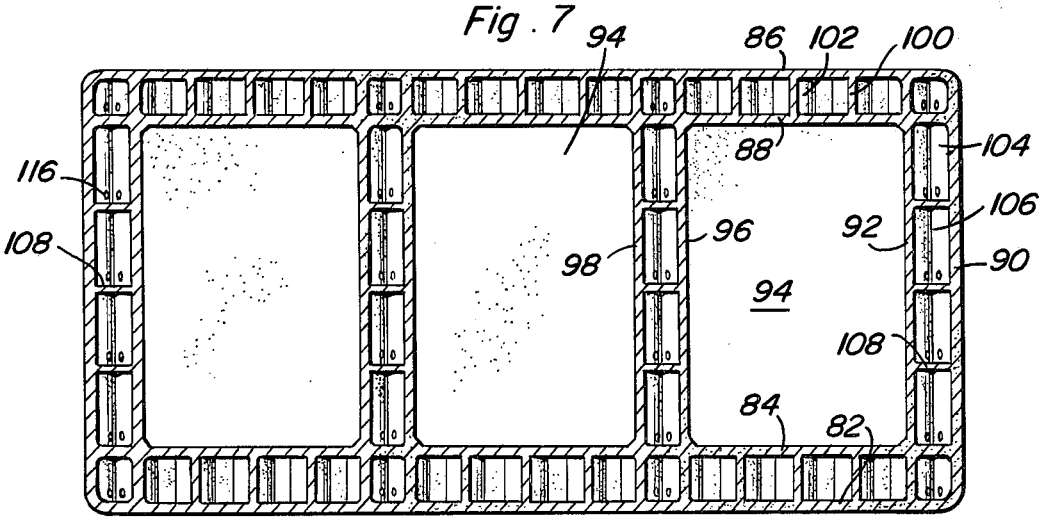
FIG. 7 is a transverse, sectional view taken substantially upon a plane passing along section line 7—7, on an enlarged scale, illustrating further structural details of this embodiment of the invention.
Figure 8:
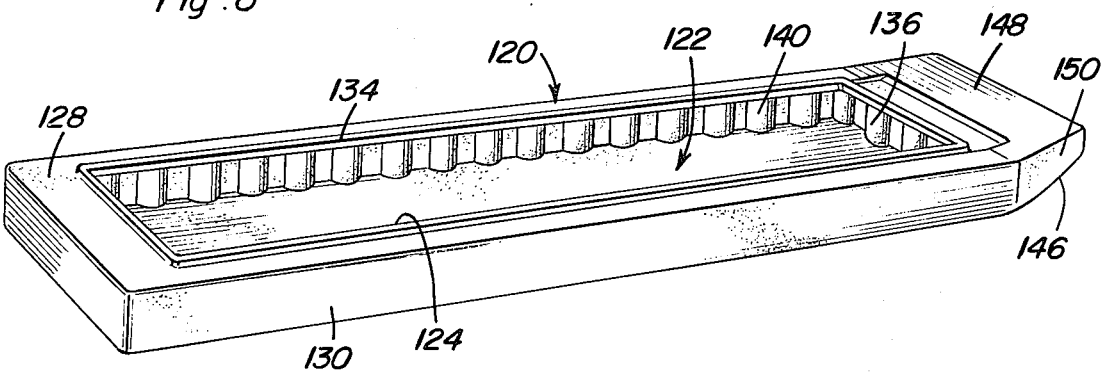
FIG. 8 is a perspective view of a river barge illustrating a continuous cargo hold extending substantially throughout the length of the barge.

Referring now specifically to FIGS. 5–7, another embodiment of the marine vessel is illustrated and generally designated by reference numeral 80 which structure is useful as a storage barge as well as a facility for LNG liquefaction with this structure including a bottom shell 82 with an intermediate deck or shell 84 spaced closely therefrom and a top deck or shell 86 with an intermediate shell or deck 88 spaced closely therefrom as illustrated in FIG. 7. Interconnecting the peripheries of the top and bottom deck assemblies is an exterior side wall 90 having an interior side wall 92 closely spaced in relation thereto. A portion of the length of the vessel is provided with a plurality of compartments 94 which are separated from each other by spaced partition walls 96 and 98.

Disposed between the decks 82 and 84 and between the decks 86 and 88 is a plurality of partition walls 100 having vertical cylindrical walls 102 incorporated therein in which the cylindrical walls 102 have the partition walls 100 projecting radially therefrom in the form of connecting webs between the cylindrical walls 102 with both the cylindrical walls 102 and the partition 100 extending vertically between the adjacent decks. Disposed between the exterior walls 90 and 92 and between the partition walls 96 and 98 is a plurality of semi-cylindrical walls 104 having the free edges thereof integral with the respective wall and having the arcuate portions thereof tangentially connected as at 106 as illustrated in FIG. 6. Also disposed between the walls 90 and 92 and the walls 96 and 98 is a plurality of horizontal partition plates or walls 108 which are vertically spaced and define vertical compartments between the walls 90 and 92 and between the walls 96 and 98 as illustrated in FIG. 7. The forward portion of the vessel 80 is tapered into a bow as at 110 as illustrated in FIGS. 5 and 6 and this entire area may be provided with a plurality of vertical cylindrical walls 112 interconnected by webs or partitions 114 with these cylindrical walls being continuous between the bottom shell and top deck or provided with horizontal partitions if desired. The various cylindrical annular walls and semi-cylindrical walls may be provided with vent holes 116 and any desired facilities 118 for connecting a tug or other towing vehicle to tow the barge or to provide anchoring connection with the barge as well as provide communication with the interior holds or compartments 94 which are specifically adapted to receive various types of fluids including liquefied gases and the like. In a typical construction, the size of this barge may be larger than that illustrated in FIGS. 1–4 with a substantial portion of the barge being below water when used for storage or liquefaction of gases.

FIGS. 8–11 illustrate another embodiment of the marine vessel generally designated by numeral 120 and which includes an elongated cargo hold 122 defined by a large hatch opening 124. In this embodiment of the invention, a bottom shell, deck or slab 126 is provided along with a top deck 128 and an interconnecting exterior wall 130. An intermediate or cargo deck 132 is provided as a bottom for the cargo hold 122 and is closely spaced in relation to the bottom shell 126. The periphery of the hatch opening 124 is defined by an upstanding flange 134 and the periphery of the hold 122 is defined by a plurality of cylindrical vertical walls 136 in the end portions thereof interconnected by webs or partition walls 138. The sides of the hold 122 are defined by the outer side walls 130 and semi-cylindrical vertical walls 140 connected thereto in which the horizontal deck 132 extends completely to the side walls 130 but terminates at the forward and rear partitions defined by the vertical cylindrical walls 136 and the connecting webs 138.

Figure 9:
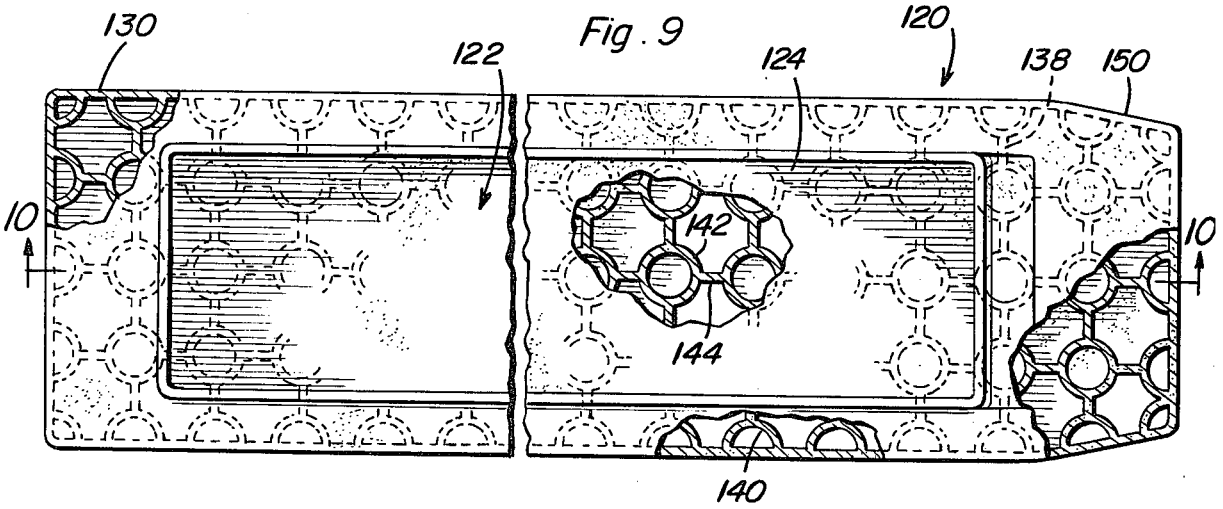
FIG. 9 is a top plan view of the embodiment of the invention illustrated in FIG. 8 with portions of the top deck and cargo deck being broken away to illustrate the structure of the vertical annular walls.
Figure 10:
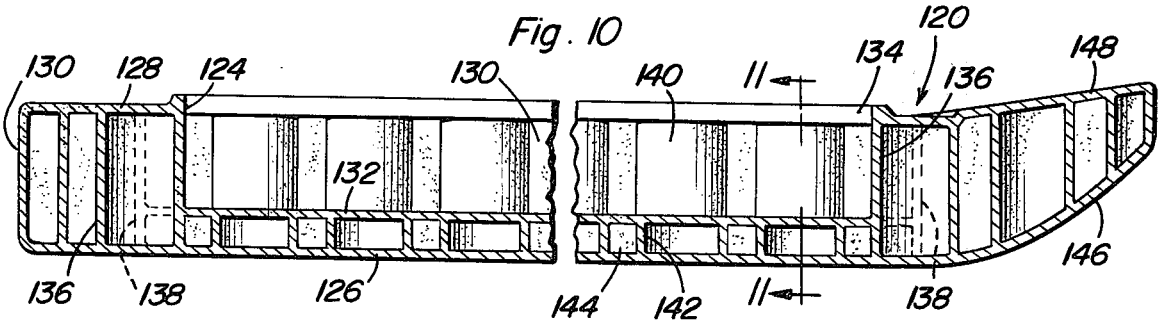
FIG. 10 is a longitudinal, vertical section view taken substantially upon a plane passing along section line 10—10 on FIG. 9 illustrating further structural details of this embodiment of the invention.
Figure 11:
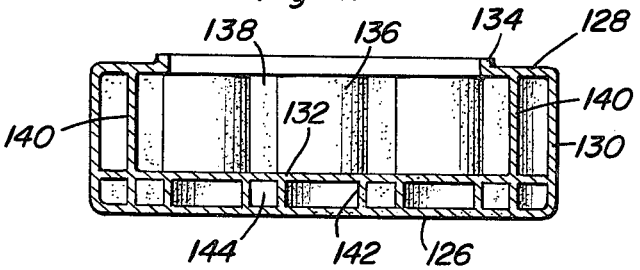
FIG. 11 is a transverse, sectional view taken substantially upon a plane passing along section line 11—11 on FIG. 10 illustrating further structural details of this embodiment of the invention.

The cargo deck 132 and the bottom shell 126 are interconnected by cylindrical walls 142 throughout their extent with the cylindrical walls 142 being interconnected by partitions or webs 144 as illustrated in FIG. 9. The entire peripheral side wall 130 is provided with the semi-cylindrical vertical walls 140 which extend from top to bottom of the vessel with the side walls being further reinforced by the cargo deck 132 extending all of the way to the side walls 130. The bow portion of the vessel includes an upwardly curved forward portion on the bottom shell or deck as indicated by numeral 146 and an upwardly slanted portion 148 on the top deck 128. As illustrated in FIG. 9, the side walls 130 also converge slightly as at 150 to provide a bow section for use of the device as a river barge or the like. Typical dimensions of this embodiment of the invention would be an over-all length of 205 feet and a beam width of 42 feet with a hatch opening of 168 feet by 30 feet.

In each embodiment of the invention, the honeycomb sandwich panel system is utilized with this system being applied to either open deck or closed deck vessels including a single cargo hold or multiple holds or compartments. These compartments, holds or tanks may be utilized for storage or transportation of various products and materials including dry materials, liquid materials or gaseous materials with appropriate facilities being provided for storing such material and conveying the materials to and from the storage holds, compartments or tanks. The marine vessel may also be employed as a floating vessel or partially submerged and in some instances completely submerged if desired thus enabling underwater storage of products. The marine vessel may be constructed of reinforced concrete, prestressed concrete, structural steel, or any other moldable materials. The vessel is primarily intended for use in areas that are not subject to extreme wave action or rough water but the mobility of the vessel enables storage facilities to be relocated when desired in order to obtain optimum use of such facilities. The annular walls, preferably, but not necessarily, cylindrical in shape are interconnected by webs or partitions or oriented tangentially with the wall structures including the annular walls being integral. Thus, the annular walls combined with the webs and partition walls as well as external walls define a continuous, honeycomb-like network extending between the bottom slab or shell and intermediate deck or completely to the top deck or slab thereby providing a more versatile arrangement of cargo receiving space with the honeycomb network greatly enhancing the over-all strength of the structure.

Each annular wall or cylindrical wall serves as a vertical shear wall between a lower wall, deck or slab and an upper or higher wall, deck or slab. Also, the spaces or compartments defined by the annular walls may be filled with flowable material with the annular walls serving as baffles to reduce movement of such flowable materials with the cylindrical walls also enabling equalization of pressures on the inner and outer surfaces of the cylindrical walls. The vertical shear walls defined by the annular walls and the interconnecting webs resist shear in both the longitudinal and transverse directions with the combination of these walls with the horizontal decks and peripheral walls serving to provide a rigid hull structure resistant to shear, bending and flexing due to wave action and the like. It is pointed out that various shapes and configurations of the structural honeycomb sandwich are contemplated and thus shapes and uses other than those shown in FIGS. 1–11 fall within the purview of this invention. For instance, submerged platforms for kelp forming, submerged platforms for ocean storage and the like are contemplated at the present time and other uses and configurations will evolve in the future. Also, it is emphasized that the cylinders, internal walls, external walls and top and bottom slabs for the structural honeycomb system can be made out of structural steel, concrete, or other cementitious materials or any combination thereof. For example, in one type barge, the cylinder walls and internal flat walls of the honeycomb structure are of structural steel while the external walls and top and bottom slabs are constructed of prestressed concrete. This arrangement enables a substantial improvement in the deadweight cargo capacity of the vessel. Also, due to fluctuation in steel prices, this combination of materials can provide the advantage of utilizing low priced structural steel for the internal honeycomb structure and the durable prestressed concrete for the exterior hull, sidewalls and top and bottom slabs.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A marine vessel for storage, support or transportation of material comprising a continuous rigid exterior peripheral wall, a continuous rigid bottom wall connected to and extending between the lower portions of said peripheral wall to define an enclosure, a plurality of rigid annular walls connected to and extending axially upward from said bottom wall to define a plurality of compartments separate from each other, a rigid top wall connected to said peripheral wall, and at least one intermediate wall generally paralleling said top and bottom walls and being disposed in adjacent spaced relation to one of said walls, certain of said annular walls extending rigidly between the intermediate wall and the adjacently related top or bottom wall, said rigid annular walls, peripheral wall, top and bottom walls and intermediate wall being of integral cementitious construction with the annular walls being rigidly connected with each other and the other wall forming the enclosure, said annular walls being cylindrical.

2. The structure as defined in claim 1 wherein said cylindrical walls are interconnected by interconnecting radial partition walls.

3. A marine vessel for storage, support or transportation of material comprising a continuous rigid exterior peripheral wall, a continuous rigid bottom wall connected to and extending between the lower portions of said peripheral wall to define an enclosure, a plurality of rigid annular walls connected to and extending axially upward from said bottom wall to define a plurality of compartments separate from each other, a rigid top wall connected to said peripheral wall, and at least one intermediate wall generally paralleling said top and bottom walls being disposed in adjacent spaced relation to one of said walls, certain of said annular walls extending rigidly between the intermediate wall and the adjacently relative top or bottom wall, said rigid annular walls, peripheral wall, top and bottom walls and intermediate wall being or integral cementitious construction with the annular walls being rigidly connected with each other and the other wall forming the enclosure, certain of said annular walls being semi-cylindrical in configuration and tangentially connected.

4. A marine vessel for storage, support or transportation of material comprising a continuous rigid exterior peripheral wall, a continuous rigid bottom wall connected to and extending between the lower portions of said peripheral wall to define an enclosure, a plurality of rigid annular walls connected to and extending axially upward from said bottom wall to define a plurality of compartments separate from each other, a rigid top wall connected to said peripheral wall, and at least one intermediate wall generally paralleling said top and bottom walls and being disposed in adjacent spaced relation to one of said walls, certain of said annular walls extending rigidly between the intermediate wall and the adjacently related top or bottom wall, said rigid annular walls, peripheral wall, top and bottom walls and intermediate wall being of integral cementitious construction with the annular walls being rigidly connected with each other and the other wall forming the enclosure, said marine vessel including a vertical partition wall defining a cargo hold, said partition wall extending upwardly from the intermediate wall, said intermediate wall being diposed in spaced relation to the bottom wall, and an upper intermediate wall spaced adjacent but below the top wall with the partition wall extending between the intermediate walls.

5. The structure as defined in claim 4 in which certain of said partition walls are provided with semi-cylindrical annular walls rigid therewith.

6. The structure as defined in claim 4 wherein said top wall and top intermediate wall are continuous to form a closed cargo hold.

7. A marine vessel for storage, support or transportation of material comprising a continuous rigid exterior peripheral wall, a continuous rigid bottom wall connected to and extending between the lower portions of said peripheral wall to define an enclosure, a plurality of rigid annular walls connected to and extending axially upward from said bottom wall to define a plurality of compartments separate from each other, a rigid top wall connected to said peripheral wall, and at least one intermediate wall generally paralleling said top and bottom walls and being disposed in adjacent spaced relation to one of said walls, certain of said annular walls extending rigidly between the intermediate wall and the adjacently relative top or bottom wall, said rigid annular walls, peripheral wall, top and bottom walls and intermediate wall being of integral cemetitious construction with the annular walls being rigidly connected with each other and the other wall forming the enclosure, said top wall including an enlarged opening therein defining a single hatch opening, said intermediate wall being disposed adjacent the bottom wall and the extending laterally to the side portions of the peripheral wall, the side portions of the peripheral wall having semi-cylindrical annular walls rigid therwith and extending from the top to bottom wall.

8. A marine vessel for storage, support or transportation of material comprising a continuous rigid exterior peripheral wall, a continuous rigid bottom wall connected to and extending between the lower portions of said peripheral wall to define an enclosure, a plurality of rigid annular walls connected to and extending axially upward from said bottom wall to define a plurality of compartments separate from each other, a rigid top wall connected to said peripheral wall, and at least one intermediate wall generally paralleling said top and bottom walls and being disposed in adjacent spaced relation to one of said walls, certain of said annular walls extending rigidly between the intermediate wall and the adjacently related top or bottom wall, said rigid annular walls, peripheral wall, top and bottom walls and intermediate wall being of integral cementitious construction with the annular walls being rigidly connected with each other and the other wall forming the enclosure, said top wall being provided with a plurality of hatch openings therein, a plurality of transverse partitions and longitudinal partitions associated with the intermediate wall disposed in adjacent relation to the bottom wall thereby defining a plurality of holds, the partition walls defining the sides of said hold being smooth and the transverse partition walls being defined by cylindrical annular members interconnected by webs.

9. The structure as defined in claim 8 wherein said annular walls include openings therein to provide communication between the compartments defined thereby.

10. A concrete hull structure comprising a monolithic bottom wall, upstanding side walls and end walls and at least a partial top wall connected with the side walls to define an enclosure, an intermediate cargo deck spaced above the bottom wall, a plurality of cylindrical walls extending between the bottom wall and intermediate deck, said intermediate deck having less dimensions than the bottom wall and top wall, vertically extending annular walls interconnection the bottom wall and top wall outwardly of the intermediate deck with certain of the annular walls outwardly of the intermediate deck defining a partition wall to delineate a cargo hold in which the intermediate deck forms the bottom wall.

11. The structure as defined in claim 4 wherein said annular walls include openings therein to provide communication between the compartments defined thereby.

* * * * *